United States Patent [19]

Sinha

[11] Patent Number: 4,591,431

[45] Date of Patent: May 27, 1986

[54] PROCESS FOR SEPARATING POROUS MATERIALS FROM LESS POROUS MATERIALS

[76] Inventor: Rabindra K. Sinha, 103 Lansdowne Dr., Coraopolis, Pa. 15108

[21] Appl. No.: 658,627

[22] Filed: Oct. 9, 1984

[51] Int. Cl.[4] ..... B03B 5/28

[52] U.S. Cl. ..... 209/3; 209/164; 209/173; 209/172

[58] Field of Search ..... 209/3, 4, 7, 9, 2, 163, 209/164, 165, 172, 172.5, 173, 11, 1; 75/2; 127/49, 57; 502/21; 73/38

[56] References Cited

U.S. PATENT DOCUMENTS

| | | | |
|---|---|---|---|
| 1,152,442 | 9/1915 | Schniewind | 209/4 |
| 1,905,945 | 4/1933 | Machen | 209/173 |
| 2,150,917 | 3/1939 | Foulke et al. | 209/172 |
| 2,208,758 | 7/1940 | Foulke et al. | 209/172 |
| 2,459,967 | 1/1949 | Schilling | 209/9 |
| 3,394,893 | 7/1968 | Moss et al. | 209/164 |
| 4,178,231 | 12/1979 | Smith | 209/172 |
| 4,308,133 | 12/1981 | Meyer | 209/166 |
| 4,450,070 | 5/1984 | Hefner | 209/3 |

FOREIGN PATENT DOCUMENTS

| | | | |
|---|---|---|---|
| 491681 | 3/1953 | Canada | 209/173 |
| 551336 | 1/1958 | Canada | 209/172 |
| 0783657 | 11/1980 | U.S.S.R. | 73/38 |

*Primary Examiner*—S. Leon Bashore
*Assistant Examiner*—William Bond

[57] ABSTRACT

A process for separating porous components from non-porous components of a mixture of granular materials comprising the steps of:

(a) contacting the mixture of the porous and non-porous materials with a gas capable of adsorbing in the pores of the porous component;

(b) discharging the so charged or loaded mixture into a liquid in which the adsorbed gas is allowed to desorb from the porous componet, the viscosity and surface tension of the liquid being chosen so that the desorbed gas remains attached to the porous component with the specific gravity of the liquid chosen to separate the so desorbed porous component from the nonporous component; and (c) separating the floating materials from those of sinking materials in the liquid of Step (b).

3 Claims, No Drawings

PROCESS FOR SEPARATING POROUS MATERIALS FROM LESS POROUS MATERIALS

BACKGROUND OF THE INVENTION

In many industrial and mining operations, the intermediate or the finished product is a granular material which often consists of a mixture having components of varying density and porosity. In many situations, it is required that the valuable components from the mixture be first separated before its end use. In many such instances, it is possible to separate the components and recover the valuables by physical processes such as gravity separation, screening, etc. However, when the density difference between the various components of the mixture or their particle size or properties other than those described herein is not significant, then the process of separating it into its components not only becomes difficult, but is also ineffective. However, the difference in the density of one component over the other can be significantly increased provided the porosities of the individual components is different. Separation of coal from its organic impurities, commonly known as ash, is such an example.

Coal is a heterogeneous mixture of organic (macerals) and inorganic (mineral) matters. The distribution of its components and its chemical compositions varies widely with the geographic location of the coal and coal type. The inorganic content of the raw (freshly-mined) coal varies from a few percentage points to as high as 40%, and it consists largely of shales and clays, calcium and magnesium carbonates and sulfides of iron known as pyrites. The bulk of this inorganic impurities in raw coal falls into the category of "extraneous" ash. The extraneous ash includes the sedimentary material laid down as "dirt bands" on top of the plant remains which, with time, was converted to coal, mineral deposits (usually carbonates) from percolating solutions late in the coal-forming process, and the roof and floor materials that are usually mined along with the coals, especially in the continuous mining coperations. These impurities are not bound tightly to the coal and, therefore, a significant portion of it can be liberated from the coal by crushing and grinding operations.

Two properties of coal macerals that differ from those of the mineral impurities form the basis of virtually all the physical coal cleaning processes: specific gravity and the surface characteristics. Based on the existing knowledge of coal and its impurities, it can be stated that the organic portion of the coal is less dense and more hydrophobic than its inorganic impurities. Table I illustrates the point on the density differences:

TABLE I

| Specific Gravities of Coal and Its Mineral Impurities | |
|---|---|
| Component | SP. Gr. |
| Coal | 1.3 to 1.7 |
| Shales and Clays | 2.0 to 2.7 |
| Calcium and Magnesium Carbonates | 2.0 to 2.5 |
| Pyrites | 4.5 to 5.0 |

The major commercial cleaning processes for coal crushed into a particle size range of 0.01" to 2" are based on density differences, whereas methods based on surface characteristics such as froth flotation, selective flocculation, etc., are used for coal particles having a size range between 0.001" to 0.01".

Despite the density and hydrophobicity differences between the coal and its inorganic impurities, the extent of separation achieved by existing commerical techniques cannot be termed exceptionally successful. Table II shows the extent of separation obtained on coals of three different ranks based on the present "float and sink" method.

TABLE II

| Gravity Separation of Coal | | | |
|---|---|---|---|
| Gravity Fraction | 1.3 × 1.7 | 1.7 × 2.1 | 2.1 (sink) |
| Coal A: | | | |
| Rank: High Volatile A | | | |
| Total Composite Ash: 13% | | | |
| weight % coal | 67 | 14.5 | 18.5 |
| % ash (on material retained in each gravity fraction) | 9.2 | 17.2 | 33.0 |
| Coal B: | | | |
| Rank: High Volatile C | | | |
| Total Composite Ash: 9.5% | | | |
| weight % coal | 91.0 | 6.5 | 2.5 |
| % ash (on material retained in each gravity fraction) | 6.0 | 36.9 | 74.2 |
| Coal C: | | | |
| Rank: Sub-bituminous C | | | |
| Total Composite Ash: 12.0% | | | |
| weight % coal | 95.0 | 3.0 | 2.0 |
| % ash (on material retained in each gravity fraction) | 6.2 | 31.0 | 74.3 |

It can be noted from Table II that the fraction of coal retained in the gravity fraction of 1.3×1.7 has lower ash content than the parent coal, whereas the ash in the higher gravity fractions are higher. Thus, the coal separated in the 1.3×1.7 gravity fraction is richer in organic content and leaner in impurities. In other words, the coal has been beneficiated. It is to be further noted that even though the inorganic impurities has been reduced in the beneficiated fraction, the reduction in the ash content for Coal C has been about 50%, whereas in the case of Coal A and Coal B, which are of more commercial importance than Coal C, it is even less than 35%. The extent of beneficiation by the float and sink method cannot be, therefore, termed exceptional.

The organic fraction of coal is known to be highly microporous, whereas the mineral impurities it contains are primarily non-porous. For the purpose of this disclosure, a microporous substance is defined as that fraction of the void of a specific volume of the material that is contained in pores ranging in equivalent cylindrical diameters between 3 Angstroms to 100,000 Angstroms. The organic fraction of a coal, because of its porosity, adsorbs significant quantities of such fluids as air, other gases, vapors and liquids. It is due to this microporosity that coal can contain up to 2200 cubic feet of methane per ton of its weight. It is because of this inherent microporosity that materials of high internal surface area, such as activated carbon, can be produced from coal.

One of the measures of microporosity of coal is its internal surface area, which can be measured by adsorbing carbon dioxide and by employing the Dubinin-Polanyi equation. Other measures of microporosity are the differences between the X-ray, helium and mercury densities. The surface areas of some coals, as measured by adsorbing carbon dioxide and employing the Dubinin-Polanyi equation are compared in Table III.

TABLE III

Surface Areas of Various Coals Determined from Carbon Dioxide Adsorption

| Coal Type | Surface Area ($m^2/g$) |
|---|---|
| Anthracite A | 238 |
| Anthracite B | 274 |
| Medium Volatile Bituminous A | 133 |
| High Volatile Bituminous C | 144 |

As can be seen from Table III, the surface area of coal is generally in the hundreds of $m^2/g$. The surface areas of the inorganic impurities, on the other hand, hardly approach 10 $m^2/g$.

DESCRIPTION OF THE INVENTION

The instant invention is directed to a process of separating porous components from non-porous components of a mixture of granular materials comprising the steps of:

(a) charging the mixture of porous and non-porous materials at a total pressure of one atmosphere and above with a fluid capable of adsorbing in the pores of the porous materials for a period exceeding one second, and then (b) discharging the so exposed or loaded material into a liquid of specific gravity exceeding 0.5 and viscosity exceeding 0.5 centipoise maintained at a temperature above the boiling point of the charging fluid used in Step (a), above, and (c) separating the floating materials from those of sinking materials.

The mechanism by which the separation is affected is believed, although not construed as exclusive, is as follows: In the charging process, the pores contained in the porous material are at least partially filled by the fluid the mixture is exposed to. In other words, the fluid is preferentially adsorbed by the porous components of the mixture. The non-porous components, on the other hand, adsorb very little of the fluid. In the second step of the process, the adsorbed fluid is expelled from the microporous material due to a combination of pressure and temperature differences between the first and the second steps. A portion of the gaseous fluid that is expelled from the pores of the microporous particles are caught and remain attached to the outer surface of the particles of porous material as minute bubbles. The expelled fluid remains attached as tiny bubbles due to factors such as surface properties of the particle and the surface tension and the viscosity of the liquid in which the exposed mixture is discharged. The attachment of the expelled fluid in the form of tiny bubbles to the microporous particles induces a much greater density difference between the porous and the non-porous materials. This makes the porous material much more buoyant and, thus, have a greater tendancy to rise or float in the liquid the loaded material is discharged. The non-porous component, which is expected to maintain its original density due to the lack of significant adsorption and attendent expulsion and attachment of the fluid, therefore, tends to sink in the fluid the mixture is discharged.

According to the present invention, any porous material having a microporosity, as measured by the adsorption of carbon dioxide and quantified by employing the Dubinin-Polanyi equation for the determination of surface area, in the range of 5 to 1000 $m^2/g$, preferably 50 to 800 $m^2/g$ and having specific gravity in the range of 0.5 to 13, preferably in the range of 0.8 to 5, can be separated from components having carbon dioxide surface area of less than 10 $m^2/g$ and having specific gravity in the range of 0.8 to 15, preferably 1 to 8. Examples of porous materials are coal, activated carbon, polymeric beads, exfoliated clays, vermiculite, activated clays, diatomaceous earth and the like. Examples of non-porous materials are inorganic impurities of coal, commonly known as ash, dolomite, pyrite, naturally occuring ores of iron, tin, nickel and the like.

The fluid employed in the charging process can be air or its major components, carbon dioxide, helium, argon, etc. and those organic and inorganic fluids that exist as vapor or gas at or below 200° C. Examples of organic fluids that boil below 200° C. are butane, propane, pentane, hexane, methylene chloride, carbon tetrachloride, freon, benzene, toluene, cyclohexane and the like. Examples of inorganic compounds are ammonia, hydrides of boron, phosphorus, arsenic and the like, hydrogen chloride and the like.

The liquid into which the discharging step is conducted is either a pure liquid or a mixture of various miscible liquids or a mixture of soluble or insoluble compounds in water or organics such that its specific gravity lies in the range of 0.8 to 13.6, preferably from 0.8 to 2.5, viscosity in the range of 0.5 to 100,000 centipoise, preferably from 1 to 10,000 centipoise, surface tension in the range of 0.0001 to 100 dynes/cm and is maintained at a temperature ranging from −40° C. to 400° C., preferably between 20° to 110° C. The most common example of such a liquid is water or water to which compounds which alone or in combination modify its viscosity, surface tension, specific gravity and pH.

Examples of organic liquids are aliphatic hydrocarbons, alcohols or acids having 1 to 12 carbon atoms, aromatic hydrocarbons or such containing substituted hologens such as carbon tetrachloride, tribromomethane and the like.

Examples of viscosity modifying compounds are various anionic, cationic and neutral polymeric compounds of molecular weight ranging from 100,000 to 1,000,000.

Surface tension modifiers are surfactnts such as organosulfonic acids like dodecyl benzene sulfonic acid and the like, and others whereas specific gravity can be modified by soluble compounds such as common salt, ammonium chloride, sodium sulfate, ammonium nitrate and the like and by finely divided insoluble materials such as iron oxide and the like.

The floating materials after the completion of Step (b), above, is separated from the sinking materials by such techniques as skimming, decanting, fluidization or others commonly known in the art.

EXAMPLES

Examples of the effectiveness and general substantiation for the claims are given below:

EXAMPLE 1

This example demonstrates that coal is microporous and can adsorb significant volumes of carbon dioxide in its micropores:

A high volatile "C" coal from Illinois No. 6 seam was crushed and sized to 20×60 mesh fraction. Dry ice was utilized as a convenient source of carbon dioxide for conducting the experiments. 5.09 g of the said coal was placed in a preweighed plastic bag to which a few pellets of dry ice was added. The plastic bag was partly sealed and the mixture of dry ice and the coal was left to stay together for a period of 15 minutes. After 15 minutes, the unused portions of the dry ice pellets were removed from the bag and the bag was squeezed to expell most of the gaseous carbon dioxide from the empty space of the bag. The bag was reweighed. The difference in the weight is the amount picked up by the coal. Based on the molecular weight of carbon dioxide, the weight picked up by the coal is converted into volume of carbon dioxide. Similarly, from the knowledge of the density of the coal, the weight of the coal used in the test is converted to its volume. The experimental values, together with the volume conversion data, are presented in Table IV. It can be seen from this table that the coal picked up 18 times its volume in carbon dioxide, indicating that coal is a porous material.

TABLE IV

Volume of Carbon Dioxide Adsorbed by High Volatile "C" Coal

| Coal Weight (g) | | Weight Difference | Volume Adsorbed | Volume of Coal | Volume $CO_2$/ |
|---|---|---|---|---|---|
| Initial | Final | (g) | ml (STP) | (ml) | Coal |
| 5.09 | 5.21 | 0.12 | 61.1 | 3.39 | 18.0 |

EXAMPLE 2

A bituminous grade of coal from Kentucky was pulverized such that 90% passed through 200 mesh U.S. screen. The coal was dried in an oven maintained at 110° C. for one hour and then cooled to room temperature. A 5 g weight of the dried and cooled coal was placed in a pre-weighed glass beaker. A few pellets of dry ice weighing about 13.6 g were placed in the beaker and the beaker was partly covered. The mixture was allowed to stand for 15 minutes. After this exposure period, the unused portions of the pellets were removed. The outside of the beaker was wiped dry of the condensed moisture, and the coal was stirred to expell the unadsorbed carbon dioxide from the head space. The beaker containing the coal and adsorbed carbon dioxide on it was re-weighed. From the weight difference and the knowledge of the coal's denisty, the amount and the volume adsorbed are reported in Table V.

TABLE V

Volume of Carbon Dioxide Adsorbed by A Bituminous Coal

| Coal Weight (g) | | Weight Difference | Volume Adsorbed | Volume of Coal | Volume $CO_2$/ |
|---|---|---|---|---|---|
| Initial | Final | (g) | ml (STP) | (ml) | Coal |
| 5.00 | 5.11 | 0.11 | 56 | 3.33 | 16.8 |

It is seen from Table V that the coal picked up approximately 17 times its volume in $CO_2$, indicating that the coal is porous in nature. Experiments carried out with other adsorbates such as air, nitrogen, methane, benzene, cyclohexane, methanol, diethyl ether and the like, also demonstrate that coal picked up these adsorbates in its pores in various quantities. The amount adsorbed depends upon the rank of the coal and the type of these adsorbates.

Examples 3 through 6 describe and compare the results of the invention disclosed in here and compare its benefits over the normal "float and sink" method normally utilized for coal beneficiation. Three coals were selected for illustrating the point: a bituminous grade of coal identified herein as Kerry Coal, a high volatile "C" coal from Illinois No. 6 seam and a bituminous coal from Kentucky. The Kerry and the Illinois No. 6 coals were sized to 20×60 mesh fraction, whereas the Kentucky coal was pulverized such that 90% passed through 200 mesh U.S. screen.

EXAMPLE 3

A 5.0 g sample of each coal was weighed in a 60 ml beaker. 50 ml of water was added to the respective coal samples. The samples were stirred and let stand for one minute. Afterwards, the slurry was decanted to separate the floating materials from the sunk materials. The separated fractions were dried in an oven, weighed and analyzed for their respective ash contents. The results of this test are shown in Table VI.

TABLE VI

Normal Float and Sink Results on Various Coals

| Coal Type | Ash (%) (whole coal) | Float Fraction Weight (g) | Float Fraction % Ash | Sink Fraction Weight (g) | Sink Fraction % Ash |
|---|---|---|---|---|---|
| Kerry | 14.4 | None | Not Done | ~5.0 | Not Done |
| Kentucky | 8.1 | 2.1 | 7.1 | 2.5 | 12.2 |
| Illinois No. 6 | 17.5 | None | Not Done | ~5.0 | Not Done |

EXAMPLE 4

This example describes the invention. The experiments were conducted to show that when a gas is allowed to adsorb in the coal in the first step, followed by its exposure to water, helps the fraction rich in coal to preferentially float over the fraction rich in impurities. The charging fluid employed in these experiments was carbon dioxide, and for keeping the experiments simple, the source of carbon dioxide employed was dry ice. A 5.0 g sample of the respective coals described in Example 2 was weighed in a 60 ml capacity beaker A few pellets of dry ice were added into the beaker and covered with a watch glass. The mixture of coal and dry ice was let stand for 15 minutes after which the unused pieces of the dry ice were removed by utilizing a pair of forceps. 50 ml of room temperature water was then added into the beaker The floated and the sunk materials after the completion of this step were removed, dried, weighed, and then analyzed for their respective ash contents. The results of this test are summarized in Table VII.

TABLE VII

Results of Float and Sink on Coals Containing Pre-Adsorbed $CO_2$

| Coal Type | Ash (%) (whole coal) | Float Fraction Weight (g) | Float Fraction % Ash | Sink Fraction Weight (g) | Sink Fraction % Ash |
|---|---|---|---|---|---|
| Kerry | 14.4 | Some | Not Done | ~5.0 | Not Done |
| Kentucky | 8.1 | 1.51 | 3.3 | 3.4 | 14.0 |
| Illinois | 17.5 | Some | Not Done | ~5.0 | Not Done |

TABLE VII-continued

| Results of Float and Sink on Coals Containing Pre-Adsorbed $CO_2$ | | | | | |
|---|---|---|---|---|---|
| | Ash (%) | Float Fraction | | Sink Fraction | |
| Coal Type | (whole coal) | Weight (g) | % Ash | Weight (g) | % Ash |
| No. 6 | | | | | |

EXAMPLE 5

In this example, the liquid employed for conducting the normal float and sink experiment was an aqueous solution of common salt having a sp. gr. of 1.13. The coal employed was Illinois No. 6. 5.0 g weight of the coal was weighed in a 60 ml beaker. 50 ml of the salt solution was poured into it and the floated materials were separated from the sunk materials. The separated materials were first washed with water to remove the salt, dried, weighed and analyzed for ash. The results are reported in Table VIII.

TABLE VIII

| Normal Float and Sink Results from Aqueous Salt Solution | | | | | |
|---|---|---|---|---|---|
| | Ash (%) | Float Fraction | | Sink Fraction | |
| Coal Type | (whole coal) | Weight (g) | % Ash | Weight (g) | % Ash |
| Illinois No. 6 | 17.6 | 1.2 | 15.7 | 3.43 | 17.8 |

EXAMPLE 6

In this example, the Illinois No. 6 coal was first exposed to carbon dioxide before conducting the float and sink test in the salt solution described in Example 5. Again, a 5 g weight of the coal was weighed in a 60 ml beaker. A few pellets of dry ice were placed in it and the beaker was covered with a watch glass. The unused portions of the dry ice pellets were removed by utilizing a pair of forceps. 50 ml of 1.13 sp. gr. salt solution was then poured into the beaker. The floated materials were separated from the sunk materials by decantation. The separated fractions were then washed with water to remove the salt, dried, weighed, and alalyzed for ash contents. The results are reported in Table IX.

TABLE IX

| Float and Sink Results from Aqueous Salt Solution When the Coal Contained Pre-Adsorbed $CO_2$ | | | | | |
|---|---|---|---|---|---|
| | Ash (%) | Float Fraction | | Sink Fraction | |
| Coal Type | (whole coal) | Weight (g) | % Ash | Weight (g) | % Ash |
| Illinois No. 6 | 17.6 | 2.05 | 8.8 | 2.67 | 21.3 |

Examples 3 through 6, described above, demonstrate that the ash content, which is a measure of separation of coal from its impurities (ash), in the float fractions is lower when the coal contained pre-adsorbed amounts of carbon dioxide than when it did not contain any pre-adsorbed carbon dioxide. Similarly, the sink fraction from coal containing pre-adsorbed $CO_2$ contained more ash than those containing no carbon dioxide. Example 6 demonstrates that a higher specific gravity liquid than water does a more effective separation of coal from its impurities.

What I claim is:

1. A process for separating a porous coal component from a nonporous gangue component in a mixture comprising the steps of;
   (a) drying the mixture and allowing said mixture to cool to a predetermined temperature,
   (b) contacting the cooled coal mixture with carbon dioxide gas at a second predetermined temperature and pressure for a time sufficient to adsorb the gas into the porous coal component in an amount significantly greater than the amounts of atmospheric air that the coal would adsorb at said second predetermined temperature and pressure,
   (c) Feeding the contacted mixture into a parting liquid of a preselected specific gravity sufficient to effect separation of the porous coal component from the nonporous gangue component wherein the temperature and pressure of the liquid is such so as to cause desorption of the contacting gas from the porous component,
   (d) maintaining the viscosity and surface tension of the parting liquid such that the desorbed gas from the coal component remains attached to said coal particle peripheral surface to effectuate separation thereof, in said parting liquid,
   (e) separating said porous coal component from said nonporous gangue in said parting liquid, and
   (f) recovering a separated coal fraction at the liquid surface from the remaining nonfloating coal and gangue, 2. The process of claim 1, wherein the liquid is of a specific gravity in the range of 1 to 1.8;

3. The process of claim 2, wherein the liquid is an aqueous salt solution.

* * * * *